US006298763B1

(12) United States Patent
Greenfield et al.

(10) Patent No.: US 6,298,763 B1
(45) Date of Patent: Oct. 9, 2001

(54) EXPLOSIVE DEVICE NEUTRALIZATION SYSTEM

(75) Inventors: Gary R. Greenfield, San Jose; Brian D. Peterson; Paul R. Gefken, both of Mountain View; Terry Henry, Fremont; Steven Kirkpatrick, Redwood City, all of CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/234,773

(22) Filed: Jan. 20, 1999

(51) Int. Cl.[7] ..... F41B 9/00
(52) U.S. Cl. ..... 89/1.13; 86/50; 102/402
(58) Field of Search ..... 89/1.13; 102/402; 86/50

(56) References Cited

U.S. PATENT DOCUMENTS

| | | | | |
|---|---|---|---|---|
| 4,046,055 | * | 9/1977 | McDanolds et al. | 86/1 |
| 4,776,255 | | 10/1988 | Smith | 89/1.13 |
| 4,955,939 | * | 9/1990 | Petrousky et al. | 102/476 |
| 4,975,888 | | 12/1990 | Kern | 367/96 |
| 5,099,747 | | 3/1992 | Smith | 89/1.13 |
| 5,524,524 | | 6/1996 | Richards et al. | 89/1.13 |
| 5,614,692 | | 3/1997 | Brown et al. | 102/307 |
| 5,675,104 | | 10/1997 | Schorr et al. | 89/1.13 |
| 5,785,038 | * | 7/1998 | Mattern | 124/56 |
| 5,856,721 | | 1/1999 | Grosch et al. | 89/1.13 |
| 5,929,363 | | 7/1999 | Neff et al. | 89/1.13 |
| 5,936,184 | | 8/1999 | Majerus et al. | 89/1.13 |

* cited by examiner

*Primary Examiner*—J. Woodrow Eldred
(74) *Attorney, Agent, or Firm*—Mark Homer

(57) ABSTRACT

An explosive device neutralization system includes a penetrating tip, a reaction stake, and a deployment mechanism. The reaction stake includes a reaction initiation material (R.I.M.) which is configured to burn, thereby dispersing burning R.I.M. beyond the reaction stake. The deployment mechanism and penetrating tip are configured to deliver a portion of the reaction stake adjacent to a bulk charge of the explosive device, such that the burning R.I.M. is dispersed to the bulk charge. The reaction stake includes a stake housing that encloses the R.I.M. proximate an egress hole in the stake housing. The reaction stake also includes an ignition system proximate the deployment mechanism. Upon activation of the deployment mechanism, the ignition system initiates burning of the R.I.M. The deployment mechanism can include a deployment charge that is connected to a detonator. Further, the detonator can include a detonating cord that extends a sufficient distance away from the neutralization system and/or explosive device to avoid harm to an operator of the neutralization system.

22 Claims, 8 Drawing Sheets

EXPLOSIVE DEVICE NEUTRALIZATION SYSTEM

U.S. GOVERNMENT RIGHTS

This invention was made with Government support under Contract Number DAAB07-98-C-6024 awarded by the U.S. Army. The Government has certain rights in this invention.

BACKGROUND OF THE INVENTION

This invention relates generally to neutralization of explosive devices, such as land mines, underwater mines, unexploded ordnance (UXO), bombs, etc. More particularly, the present invention relates to a system for neutralizing an explosive device with substantially no collateral damage.

Various explosive devices have been and may continue to be deployed around the world. These explosive devices are present in various forms and provide various threats to people, vehicles, livestock, and other property that may be near such explosive devices. For example, explosive devices may include anti-personnel or anti-vehicle land mines, or underwater mines which are targeted to destroy or damage surface or submarine vessels. In addition, unexploded ordinance (UXO) may be located near, and present a threat to, people and property. Examples of UXO include various ammunition such as aerial bombs, or shells, which may be armed but have not yet exploded. Unknown or unforeseen conditions may cause the UXO to explode inadvertently with potentially disastrous results.

In addition, various types of explosive devices, sometimes termed bombs, can be assembled and deployed in areas where an explosion could threaten people or property. For example, such a bomb may be formed and positioned by an individual in a public area of a city. Often the triggering parameters of such a bomb are either unknown and/or out of the control of authorities who would otherwise desire to disable the bomb. For each of the above-described explosive devices, it is desirable to disable the system to avoid inadvertent damage to nearby people and property.

One traditional method of disabling explosive devices is to disarm them. Disarming can entail the disconnecting of the detonator or triggering mechanism from the explosive charge. Unfortunately, the appropriate manner of such disconnection may be difficult to determine or difficult to implement, or both, resulting in a highly dangerous situation for the person disarming the explosive. Further, even after being successfully disarmed, the explosive charge may still pose a danger of explosion due to other known or unknown mechanisms. Therefore, the explosive charge must still be neutralized or otherwise disposed of.

Another traditional method of disabling an explosive device is removing and transporting the system to a location that poses less danger to people and property, and detonating the explosive device there. Unfortunately, the removal of the explosive device without detonation may prove to be impossible, impractical, or difficult. For example, during a removal attempt there may be an inadvertent explosion and damage to people and/or property. Further, even if the explosive device was successfully removed, an inadvertent explosion and/or damage may occur during transit of the explosive device to a desired detonation location. Finally, even if the explosive system is successfully removed and transported to a desired detonation location, the detonation will necessarily involve collateral damage at the detonation site or require the provision of an explosion-resistant container.

The explosive device can also be conventionally disabled by in-place detonation where the explosive charge is triggered to explode. This method is often practiced in the case of land mines. FIG. 1 depicts one example of a land mine 10 that is buried in the ground 12 below the ground surface 14. While the land mine 10 shown in FIG. 1 is covered with soil, such mines can also be covered with foliage or other camouflage, or can be uncovered. Mines of this type can be mechanically or non-mechanically (e.g., influence-type) activated. An influence-type mine contains an explosive bulk charge which is triggered by nonmechanical external conditions. For example, such a mine can be triggered by the detection of a sufficiently large and sufficiently close metal object. In contrast, a mechanically activated land mine is triggered in response to mechanical application of a force to one or more parts of the land mine. For example, in the land mine 10 shown in FIG. 1, a triggering device 16 is connected to a bulk charge 18 that is explosive. The triggering device 16 can include one or more plates supported by one or more springs. When a sufficient amount of pressure is imparted to the plates of the triggering device 16, for example due to a person or vehicle moving onto the portion of the ground surface 14 directly above the triggering device 16, the plates can press down. Under certain predetermined conditions of pressure or time, a fuse within the triggering device 16 can be initiated, which in turn detonates the bulk charge 18. The bulk charge can be formed of various materials such as trinitrotoulene (TNT), Composition-B, or some other explosive material.

With such an explosive device, an example of in-place detonation is shown in FIG. 1. An explosive charge 20 can be disposed on or near the ground surface 14. The explosive charge 20 can be a conventional explosive that can be remotely detonated through known methods. Such conventional explosives can include TNT, Composition-B, or others such as dilute explosive tile (DET) available from SRI International of Menlo Park, California. As the explosive charge 20 explodes, material and energy travel away from the explosive charge 20. As the material and energy from the explosive charge 20 travel in the direction of and to the land mine 10, the land mine 10, and more particularly the bulk charge 18, may experience a particular peak pressure for a particular duration, both of which are sufficient to trigger and therefore explode the bulk charge 18.

Unfortunately, the effectiveness of an explosive charge 20 formed of conventional explosives is strongly effected by how much material is between the explosive charge 20 and the land mine 10. When underground, this amount can be characterized by the medium depth MD of the medium (here the ground or soil) between the explosive charge 20 and the land mine 10 through which the explosive material and energy travels. The effectiveness is also strongly affected by the type of the ground 12 or other intervening medium between the explosive charge 20 and the land mine 10. Also, the effectiveness is affected by the overall distance from the land mine 10 to the explosive charge 20. For example, this distance is greater when there is more lateral offset between the explosive charge 20 and the land mine 10, and increases when the explosive charge 20 is exploded at larger heights above the ground surface 14.

Due to each of the foregoing factors, conventional explosive charges 20 can be unreliable for neutralizing underground land mines with a medium depth MD of greater than 10 centimeters. Also, because the land mine may be detonated by the reaction of the bulk charge 18 itself, and not the triggering device 16, the effectiveness of the conventional explosive charge 20 is affected by the particular type of bulk charge 18 used in the land mine 10. More specifically, the effectiveness is influenced by the required peak pressure and or duration required for detonating the type of material that forms the bulk charge 18.

Instead of a conventional explosive, a shaped explosive charge 22 can be used for in-place detonation of the land mine 10, as shown in FIG. 2. As shown in FIG. 1, the conventional explosive charge 20 essentially explodes with material and energy directed substantially equally in all directions. In contrast, the shaped explosive charge 22 can be configured such that when exploded, the material and energy (sometimes referred to as the "jet" and including hot molten material such as copper) are projected outward in one or more predetermined directions, with reduced or substantially no projection in other directions. Thus, the shaped explosive charge 22 can be placed near or on the land mine 10, for example near or on the ground surface 14, and remotely detonated. Upon such explosion, the jet can project into the land mine 10 with sufficient pressure and/or duration to detonate the bulk charge 18.

Unfortunately, like the conventional charge 20 of FIG. 1, the shaped explosive charge 22 effectiveness is strongly affected by the overall distance between the shaped explosive charge 22 and the land mine 10, the medium depth MD under which the land mine is disposed, and the type of ground 12 or other medium that is disposed between the shaped explosive charge 22 and the land mine 10. Also, like the conventional explosive charge 20 of FIG. 1, because the bulk charge 18 is exploded without operation of the triggering device 16, the effectiveness of the shaped explosive charge 22 in imparting the appropriate peak pressure and/or duration of such peak pressure is effected by the type of bulk charge 18 used in the land mine 10. As a further disadvantage, because a significant amount of the energy from the explosion of the shaped explosive charge 22 is directed substantially in a single particular direction, the jet can be strongly affected by obstacles in the medium between the shaped explosive charge 22 and the land mine 10. In particular, the jet can be deflected if the leading point of the jet encounters such an obstacle. Further, because the energy of the exploded shaped explosive 22 is directed and concentrated in a particular direction, the jet can puncture the land mine 10 without actually exploding the bulk charge 18. Thus, if the triggering device 16 is still operative after the shaped explosive charge 22 is exploded, the land mine 10 will remain active and may inadvertently explode under certain conditions.

Another prior art method of in-place detonation involves explosively formed penetrators (EFP), or self-forging fragments. A detonating device can be disposed some distance away from the targetted land mine, for example above the ground surface, and exploded. Upon such explosion, fragments and penetrators are formed and projected toward the explosive device. When the fragments and penetrators penetrate into the device bulk charge, they can produce the required peak pressure for the required duration to produce detonation of the bulk charge. Unfortunately, the effectiveness of the EFPs are strongly effected by the overall distance between the EFP device and the land mine, the amount and type of intervening material, and the type of explosive used for the bulk charge.

Therefore, it is desired to have an apparatus and method for neutralizing explosive devices that are more effective, are less sensitive to the medium depth MD, less sensitive to intervening obstacles, and less sensitive to the type of explosive material used for the bulk charge. Further, it is desired that such an apparatus and method disable the explosive device without exploding the bulk charge, thereby substantially avoiding collateral damage.

SUMMARY OF THE INVENTION

The present invention provides an apparatus and method for neutralizing a variety of explosive devices. Specifically, a neutralization system is provided that disables explosive devices without exploding them.

In an embodiment of the present invention, a system for neutralizing a bulk charge of an explosive device includes a reaction stake having a first end and a second end, and including a reaction initiation material that can facilitate non-explosive neutralization of the bulk charge of the explosive device. Also included is a deployment mechanism disposed near the first end of the reaction stake, and a penetrating tip disposed near said second end of said reaction stake. In some embodiments, the reaction initiation material can facilitate neutralization of the bulk charge when the reaction initiation material is burned. In particular, the reaction initiation material can include magnesium-Teflon, thermites, solid rocket propellant, and/or liquid rocket propellant.

In another embodiment, a system for neutralizing a bulk charge of an explosive device includes an array device, and a plurality of individual neutralization systems supported by the array device. Further, each individual neutralization system includes a reaction stake having a first end and a second end, and including a reaction initiation material that can facilitate non-explosive neutralization of said bulk charge of said explosive device. The individual neutralization system also includes a deployment mechanism disposed near the first end of the reaction stake and a penetrating tip disposed near the second end of the reaction stake. In some embodiments, the reaction stake further includes a stake housing in which the reaction initiation material is disposed, and the stake housing has an egress hole proximate the reaction initiation material. In addition, the reaction stake can include an ignition system proximate the reaction initiation material. More specifically, the ignition system can include an ignition fuse and a primer cap.

In yet another embodiment of the present invention, a method for neutralizing a bulk charge of an explosive device includes positioning a neutralization system relative to an explosive device that includes a bulk charge. The method also includes piercing the bulk charge with the neutralization system and bringing a reaction initiation material in contact with the bulk charge. This contact causes at least a portion of said bulk charge to be nonexplosive. In some embodiments, piercing the bulk charge includes positioning at least a portion of the reaction initiation material within the explosive device and creating an initial gap between the reaction initiation material and the bulk charge. This initial gap reduces the probability of pressure build up that can cause the bulk charge to detonate before it is rendered non-explosive by the reaction initiation material.

With these embodiments of the present invention, the reaction initiation material can be used to render the bulk charge non-explosive without exploding the bulk charge. Therefore, the explosive device can be neutralized and rendered substantially harmless with substantially no collateral damage. Further, these embodiments are less sensitive to the type or amount of intervening medium, or the existence of intervening objects between the neutralization system and the explosive device, as are prior systems. In addition, these embodiments are less sensitive to the type of explosive material used in the bulk charge. Thus a single system can be provided that can effectively neutralize a broader range of explosive devices under a broader variety of circumstances.

These and other advantages of the present invention will become apparent to those skilled in the art upon a reading of the following descriptions of the invention and a study of the several figures of the drawing.

BRIEF DESCRIPTION OF THE DRAWINGS

The present invention will be readily understood by the following detailed description in conjunction with the accompanying drawings, and like reference numerals designate like elements.

DETAILED DESCRIPTION OF THE PREFERRED EMBODIMENTS

Figure 1:
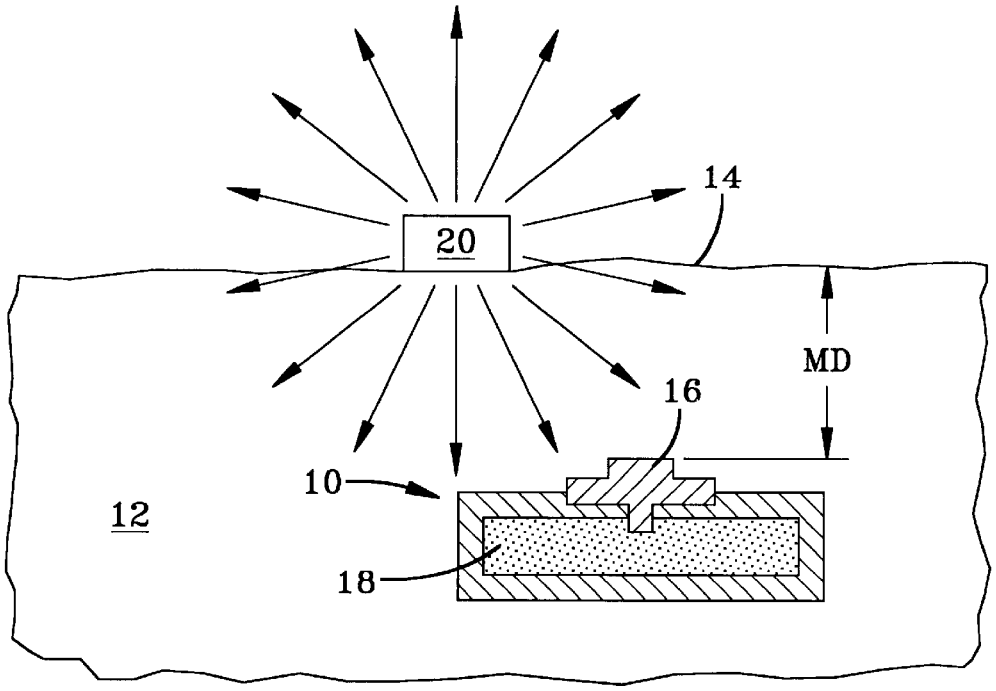
FIG-1 PRIOR ART
FIG. 1 is a schematic of a conventional charge as used to explode a buried land mine, according to the prior art.
Figure 2:
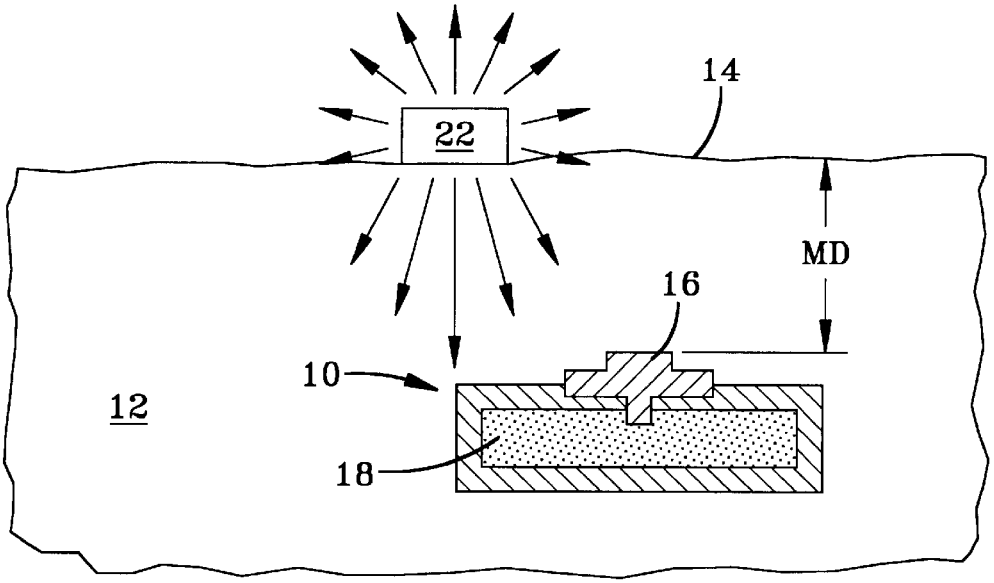
FIG-2 PRIOR ART
FIG. 2 is a schematic of a shaped charge as used to explode a buried land mine, according to the prior art.
Figure 3:
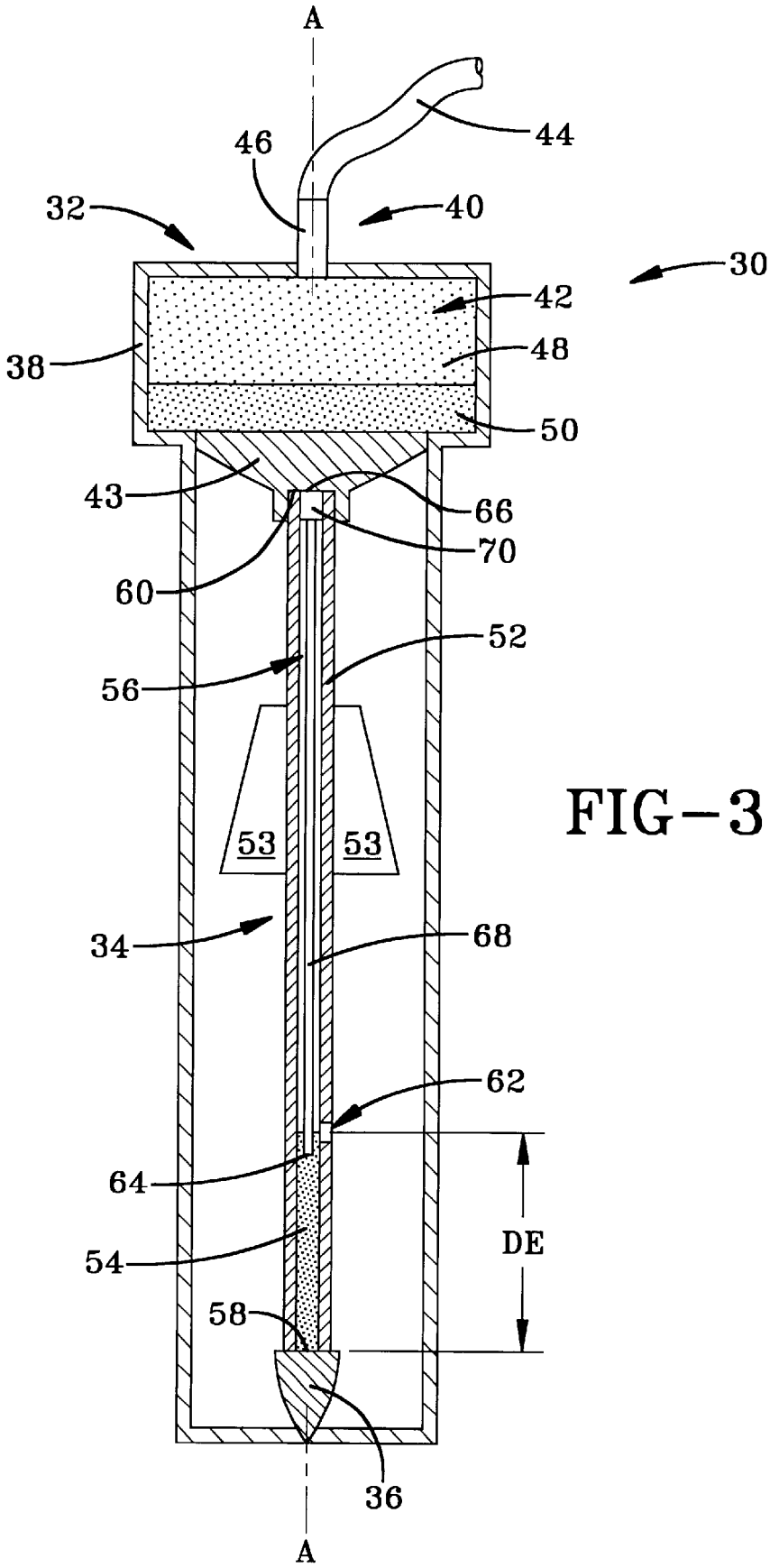
FIG. 3 is a cross-sectional view of an explosive device neutralization system, according to an embodiment of the present invention.

FIGS. 1 and 2 were discussed with reference to the prior art. FIG. 3 is a cross-sectional view of an explosive device neutralization system 30, according to an embodiment of the present invention. The neutralization system 30 includes a deployment mechanism 32, a reaction stake 34, and a penetrating tip 36, partially surrounded by a system housing 38. As shown, the system housing 38 is partially open to allow egress of the reaction stake 34 and penetrating tip 36. The system housing 38 can provide environmental protection to the other included elements, and can also provide support during deployment. However, other embodiments can work without inclusion of the system housing 38 (see FIGS. 4 and 5).

The deployment mechanism 32 includes a detonator 40, a deployment charge 42, and an anvil 43. While other types of detonators can be alternately used, the detonator 40 shown here further includes a detonating cord 44 and booster cap 46. As shown, the deployment charge 42 includes a sheet explosive 48 and a dilute explosive tile (DET) 50. For example, the sheet explosive 48 can be formed of Primasheet® which can be acquired from Ensign-Bickford of Huntington Beach, Calif., while the DET 50 is produced by SRI International of Menlo Park, Calif. Of course other various materials, structures, and combination thereof can be used in the deployment charge 42, for example gunpowder, ammonium-nitrate-fuel-oil (sometimes referred to as ANFO), or solid or liquid rocket propellant. The detonator 40 is connected to the deployment charge 42 such that activation of the detonator 40 can result in the burning of the deployment charge 42, with concomitant energy release. By way of further example, springs or compressed gas or liquid can be included in the deployment mechanism 32 and function to provide a similar energy release. Advantageously, the deployment mechanism 32 can be configured to be activated by an operator (not shown) located remotely relative to the neutralization system 30.

The anvil 43 is disposed adjacent to the deployment mechanism 32, such that the energy release is at least partially directed to the anvil 43, which is thereafter free to move in a direction away from the deployment mechanism 32. The anvil 43 can be formed of any suitable hard material, such as a metal with high compression strength, for example steel or aluminum. For some types of deployment charges such as gunpowder or rocket propellants, the anvil can also be formed of hard plastic, for example high strength polycarbonate materials, such as Lexan.

The reaction stake 34 includes a stake housing 52, stopping fins 53, a reaction initiation material (R.I.M.) 54, and an ignition system 56. The stake housing 52 has a lower end 58 and an upper end 60, as well as an egress hole 62 in a side of the stake housing 52 near the lower end 58. The stake housing 52 can be formed of any suitable material that can keep substantially its original shape before and during deployment, while substantially enclosing the R.I.M. 54 and the ignition system 56. For example, the stake housing 52 can be formed of metal or a hard plastic and can be in the shape of a tube with circular or other cross-section. The egress hole 62 extends through the thickness of the stake housing 52 and is located a distance DE from the penetrating tip 36. The distance DE can be any suitable amount (see discussion below with reference to FIG. 8), for example two inches. While a single egress hole 62 is shown, additional egress holes can also be included in the stake housing 52.

The stopping fins 53 can be formed of a suitable hard material such as metal or a hard plastic, and can be either affixed to or integral with the stake housing 52. As a reaction stake is deployed and passes into an explosive device, such passage is halted by the stopping fins 53 contacting, for example, an external surface of the explosive device. Also, because the stopping fins 53 extend outwardly more than the cross-sections of the stake housing 52 and the penetrating tip 36, the stopping fins 53 generally do not pass into a hole in the explosive device formed by the penetrating tip 36 and stake housing 52. Further, the fins can be in the form of planes oriented parallel to a direction in which the reaction stake is desired to be deployed. Thus, the stopping fins 53 can more easily pass through a medium that lies between the neutralization system 30 and the target explosive device. Of course, other configurations which provide such stopping can alternatively be used. For example, the fins can be in the form of one or more spikes radiating from the stake housing. Also, while two fins are depicted in FIG. 3, other numbers of fins can alternatively be used.

The R.I.M. 54 is disposed within the stake housing 52 near the lower end 58. The R.I.M. 54 is also positioned relative to the egress hole 62 in the stake housing 52 such that when the R.I.M. 54 burns, ignited material passes through the egress hole 62 to the outside of the stake housing 52. Of course, if other egress holes (not shown) are included, the R.I.M. can be similarly positioned relative to them. The R.I.M. 54 can be formed of any suitable deflagrating material that upon burning in contact with the bulk charge 18, can produce sufficient temperatures for a sufficient duration to initiate a thermal reaction within the bulk charge 18. The particular thermal reaction can cause the bulk charge 18 to become non-explosive, without explosion thereof. Appropriate temperatures can be at or above the auto-ignition temperature of the bulk charge 18. Examples of materials which can achieve such temperatures are magnesium-Teflon, thermites (i.e., powdered metals combined with oxidizers), and solid or liquid rocket propellant, among others.

The ignition system 56 has a lower end 64 that is in contact with the R.I.M. 54. In the specific case shown, the ignition system upper end 66 is in contact with the anvil 43. Alternative embodiments can include the ignition system near, but not in contact with, the R.I.M. 54 and/or the anvil 43. More specifically, the ignition system 56 as shown in FIG. 3 includes an ignition fuse 68 and a primer cap 70. The ignition fuse 68 extends from the lower end 64 of the ignition system 56 to the primer cap 70 at the upper end 66 of the ignition system 56. When the deployment charge 42 is burned and transfers energy to the anvil 43, the anvil 43 can contact the primer cap 70 such that it initiates burning of the ignition fuse 68. In turn, the ignition fuse 68 can initiate burning of the R.I.M. 54. Of course other suitable types of ignition systems 56 can be used alternatively to initiate burning of the R.I.M. 54.

The penetrating tip 36 can be formed of any appropriate material that has sufficient physical characteristics to penetrate an explosive device such that the stake housing 54, and more particularly the egress hole 62, is placed adjacent the bulk charge 18 within the explosive device (see FIG. 8 and related discussion below). For example, the penetrating tip can be formed of steel or other strong metal, among others. The penetrating tip 36 preferably has a shape that facilitates its penetration into the explosive device and to the bulk charge 18. For example, the penetrating tip can have a conical shape or ogival shape, among others.

Figure 8:
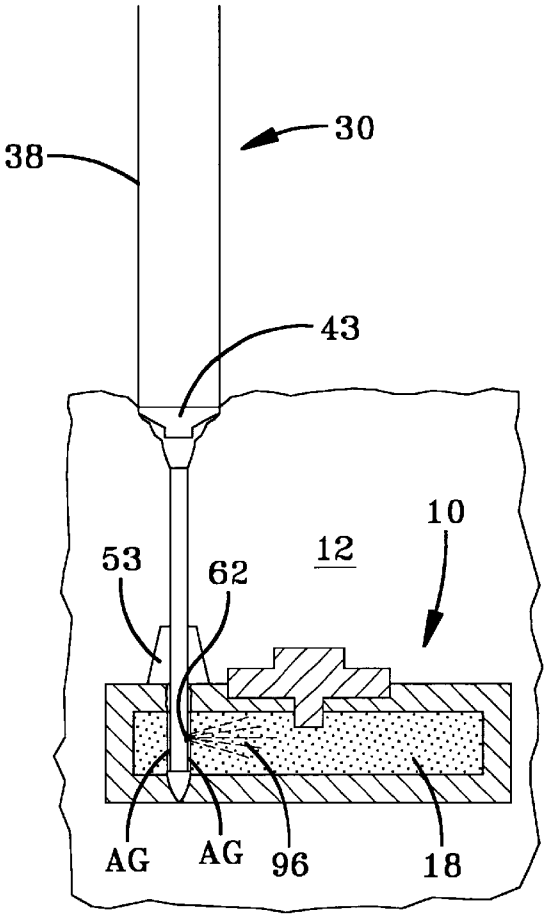
FIGS. 6–8 are illustrations of an explosive device neutralization system at various stages of deployment, according to yet another embodiment of the present invention.

As the penetrating tip 36 passes through the explosive device, it can form a hole in the explosive device with a width approximately equal to the largest width of the penetrating tip 36 (see FIG. 8 and related discussion). The largest width of the penetrating tip 36 (e.g., in FIG. 3, the width adjacent the lower end 58 of the stake housing 52) is larger than the width of the stake housing 52 at the egress hole 62. Therefore, when the portion of the stake housing 52 with the egress hole 62 is inside the bulk charge 18, there can be a gap between the stake housing 52 and the bulk charge 18. This gap at the egress hole allows for the ignited material formed by burning the R.I.M. to easily pass through the egress hole and contact the bulk charge. The difference between the largest width of the penetrating tip 36 and the width of the stake housing 52 at the egress hole 62 can be any suitable size greater than zero, for example 0.032 inches.

If the largest width of the penetrating tip 36 is larger than the widest width of the stake housing 52, then a void can be formed between the stake housing and the bulk charge from the egress hole to the point of entrance into the explosive device. This void can then allow for the escape of any gases that may be formed during burning or other neutralization of the bulk charge. Thereby, the buildup of excessive pressure, which might trigger detonation of the bulk charge, is substantially prevented.

Figure 4:
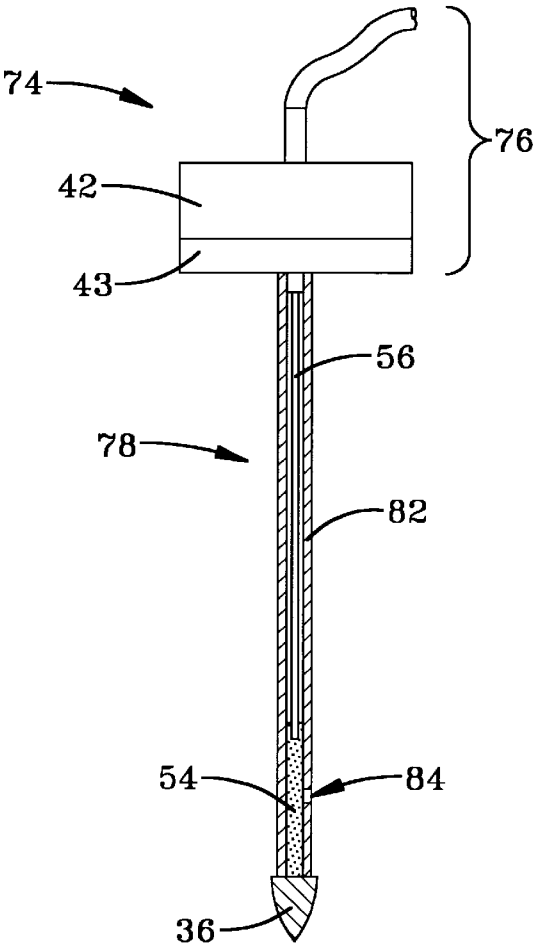
FIG. 4 is a cross-sectional view of an explosive device neutralization system, according to another embodiment of the present invention.

FIG. 4 depicts an explosive device neutralization system 74 according to another embodiment of the present invention. Similar to the neutralization system 30 of FIG. 3, the neutralization system 74 includes a deployment mechanism 76, a reaction stake 78, and a penetrating tip 36. While the R.I.M. 54 and ignition system 56 can be the same or similar to that described with respect to FIG. 3, the stake housing 82 of the system 74 can differ. In particular, the stake housing 82 can be formed of a material that, while providing an appropriate amount of structural support before and during operation, forms at least one egress region 84 during burning of the R.I.M. 54. The egress region can be in the form of a hole, ring, or other shape. In addition, the egress region can coincide with the entire length of the R.I.M., for example when the R.I.M. burns substantially all of the stake housing material adjacent to it.

With such a housing, dispersion of the burning R.I.M. 54 can be facilitated by including a penetrating tip 36 that has a largest width that is greater than the width of the stake housing 82 at the egress hole 84 and/or at any other egress holes (not shown) formed during burning of the R.I.M. 54. Alternatively, in embodiments where substantially all of the stake housing adjacent the R.I.M. is consumed, the penetrating tip 36 could have a largest width that is substantially equal to the width of the stake housing 82. This is because the burning material is directly dispersed to the bulk charge 18, without being limited to an egress hole as in the embodiment of FIG. 3, and therefore a gap between the stake housing and bulk charge is not needed. The system 74 is shown without a system housing, however it can also include such a housing, as shown in FIG. 3. Also, while no stopping fins are shown, one or more can be included as well.

Figure 5:
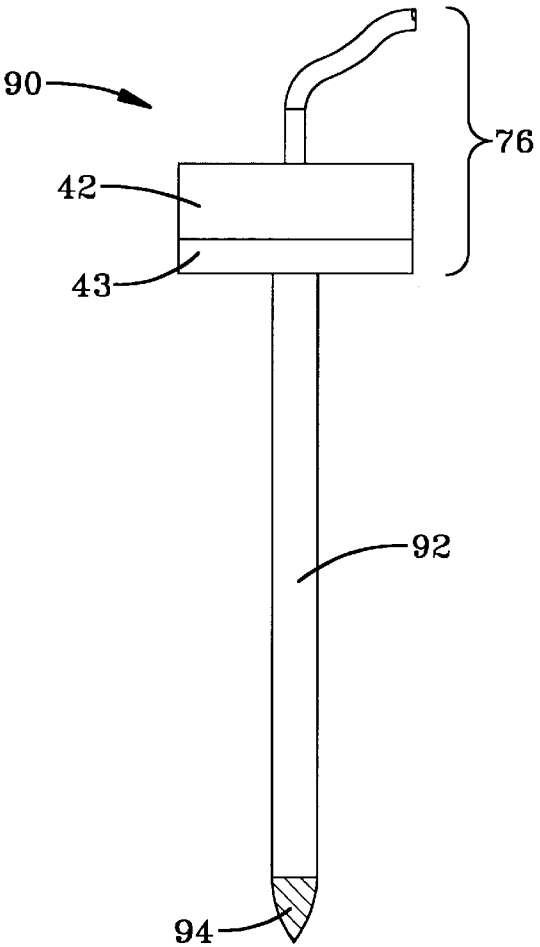
FIG. 5 is a cross-sectional view of an explosive device neutralization system, according to yet another embodiment of the present invention.

FIG. 5 shows an explosive device neutralization system 90 according to yet another embodiment of the present invention. The system 90 includes a deployment mechanism 76, which can be the same or similar to the deployment mechanisms of FIGS. 3 and 4, a reaction stake 92, and a penetrating tip 94. Although not shown, the system 90 can include a system housing similar to that shown in FIG. 3.

The reaction stake 92 of the embodiment in FIG. 5 can be formed of a material that includes reaction initiation material (R.I.M.), while substantially maintaining the structure shown in FIG. 5 before and during deployment of the system 90 into the explosive device. As with the previously described systems, when the deployment charge 42 burns or detonates, it imparts energy to the anvil 43 which, in turn, imparts energy to the reaction stake 92. The reaction stake 92 can be formed such that when the anvil 43 imparts the energy to it, the R.I.M. of the reaction stake 92 begins burning. When the reaction stake is passed into an explosive device, the burning R.I.M. is directly dispersed onto the adjacent bulk charge.

As shown, the penetrating tip 94 can have a largest width that is substantially the same as the width of the reaction stake 92. This is because the R.I.M. is already in contact with the bulk charge once the reaction stake has penetrated the bulk charge, without needing to pass through an egress hole as in the embodiment of FIG. 3. Of course, the penetrating tip can alternatively have a largest width that is larger than the reaction stake 92 width, and could thereby form a gap between the bulk charge 18 and the reaction stake 92. Also, one or more stopping fins (see FIG. 3) can be included on either or both of the embodiments depicted in FIGS. 4 and 5.

Figure 7:
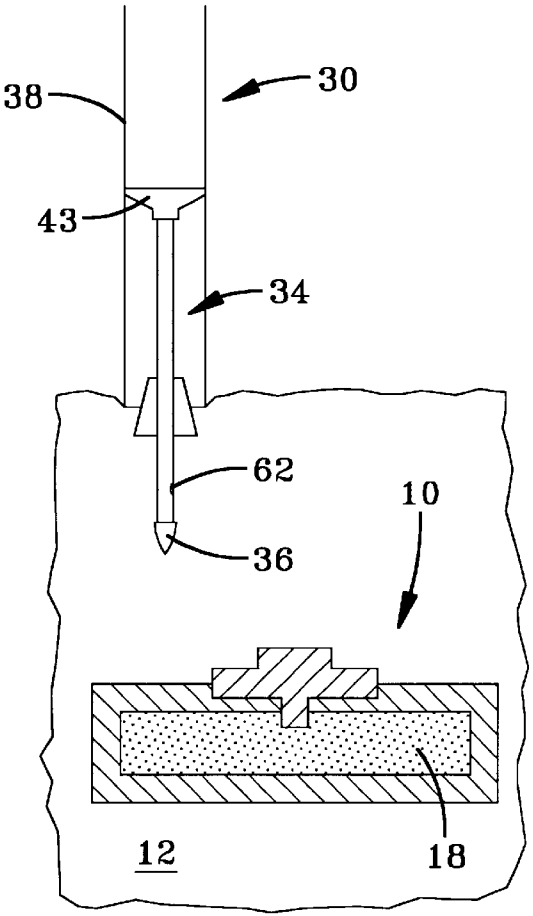
Figure 6:
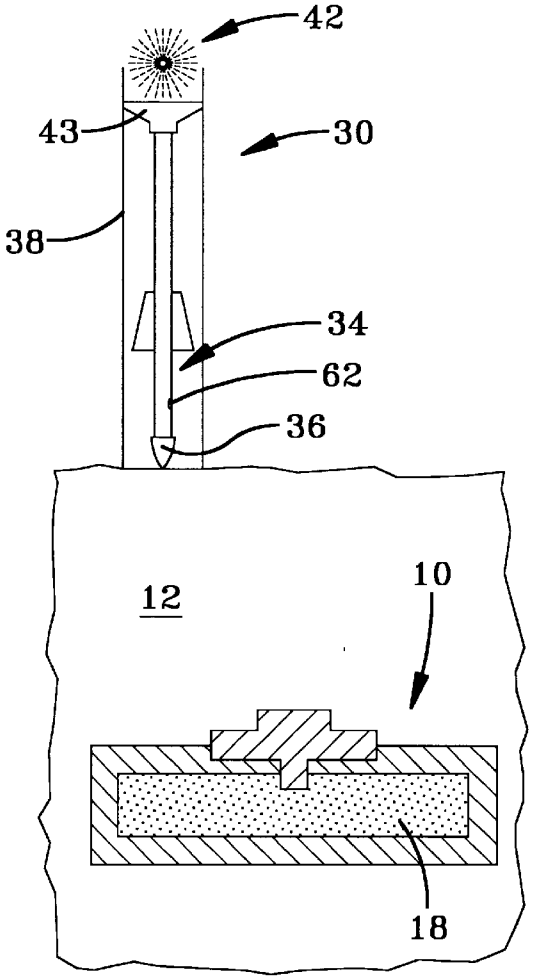

FIGS. 6–8 illustrate the operation of an explosive device neutralization system 30 according to an embodiment of the present invention to disable a land mine 10. In FIG. 6, the deployment charge has been detonated or is burning, initiating motion of the anvil 43, the reaction stake 34, and the penetrating tip 36 toward and into the ground or other medium between the system 30 and the land mine 10.

FIG. 7 shows the movement of the penetrating tip 36 and the reaction stake 34 into the ground 12 toward the land mine 10. As can be better understood with reference to these figures, the system housing 38 can provide support for the system both before burning of the deployment charge (i.e., to position the system on the ground surface above the land mine 10), and during the deployment of the penetrating tip and the reaction stake (i.e., as they pass into and through the ground). Of course, as discussed above, the present invention can also be practiced without inclusion of the system housing 38. For example, the reaction stake 34 and penetrating tip 36 can be initially inserted into the ground above the land mine 10. Alternatively, in the case of an explosive device disposed above the ground surface, a neutralization system of the present invention can be positioned to lie on the ground surface adjacent the explosive system, with the penetrating tip proximate the explosive system and the axis A—A (see FIG. 3) passing through the bulk charge. Of course the neutralization system can alternatively be supported, in an appropriate orientation relative to the explosive device, by other objects (e.g., stones, bricks, dirt mounds, etc.) that are nearby the explosive device.

As shown in FIG. 8, the deployment charge imparts enough energy to the reaction stake and penetrating tip to pass both into the land mine 10. In the case where stopping fins 53 are included, motion of the penetrating tip 36 and reaction stake 34 are stopped by the stopping fins 53 contacting the exterior of the land mine 10. In embodiments without such stopping fins 53, the penetrating tip 36 and reaction stake 34 can stop due to the resistance of the explosive device components which the penetrating tip encounters. The neutralization system is designed to stop while the egress hole 62 is adjacent the bulk charge 18.

Because the penetrating tip 36 is wider than the reaction stake 34, there is a gap AG between the reaction stake 34 and the bulk charge 18. In FIG. 8, the ignition system 56 (see FIG. 3) has begun to burn the R.I.M. 54 (see FIG. 3), thereby dispersing burning material 96 from the egress hole 62 into the gap AG and in contact with the bulk charge 18. The egress hole 62 is positioned at a distance DE (see FIG. 3) from the penetrating tip 36, that is designed to maximize the probability that the egress hole will be adjacent the bulk charge 18 after the penetrating tip stops. For example, the egress hole 62 can be positioned at a distance DE of about two inches from the penetrating tip. As can be better seen with reference to FIG. 8, this probability can be increased with the addition of other egress holes (not shown) positioned at different distances from the penetrating tip 36. The temperature of the burning material 96 is sufficiently high for a sufficient duration, to initiate a thermal reaction in the bulk charge 18, which is thereby consumed, deflagrated, or otherwise disabled and rendered non-explosive. For example, a Composition-B or TNT bulk charge can be so neutralized when raised to a temperature of about 100° C. for about 5–10 seconds. Of course, other temperatures can work well for other time durations, and for other bulk charge materials. Also, it should be understood that any exothermic process of the reaction initiation material can be used to so neutralize the bulk charge 18. As a further alternative, other types of reaction initiation materials can be used to interact with the bulk charge in other ways which neutralize the bulk charge. For example, a particular chemical could be deployed into contact with the bulk charge, that would cause the bulk charge to be chemically altered into a nonexplosive substance. Advantageously, because the bulk charge 18 is neutralized without exploding, there is substantially no collateral damage, e.g., damage to surrounding people or property.

Figure 9B:
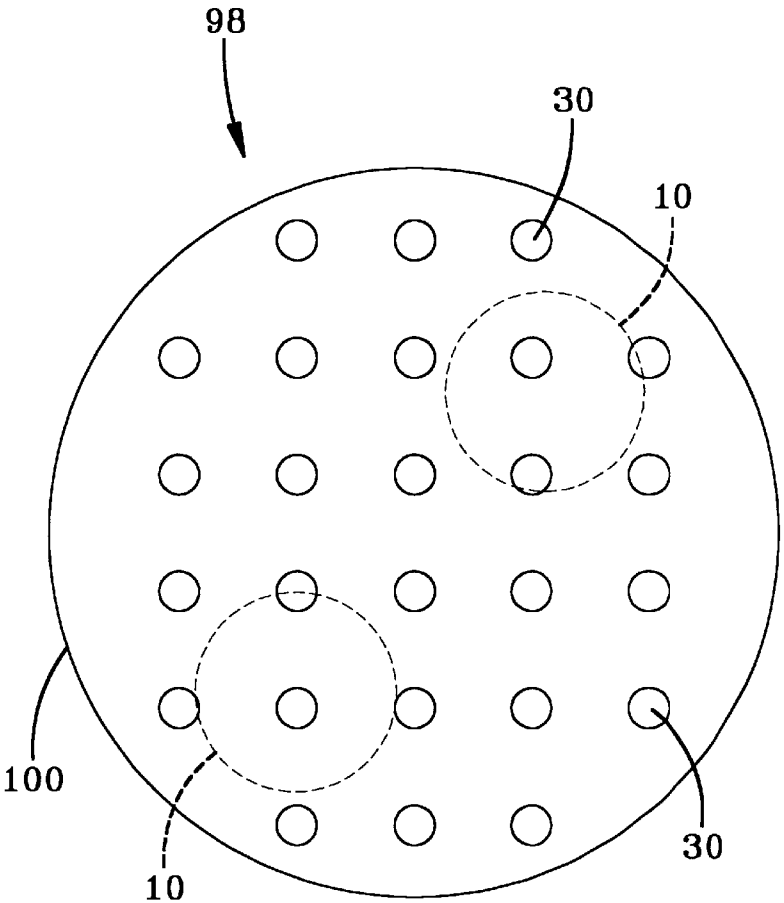
FIG. 9B is a plan view taken along line 9B—9B of FIG. 9A.
Figure 9A:
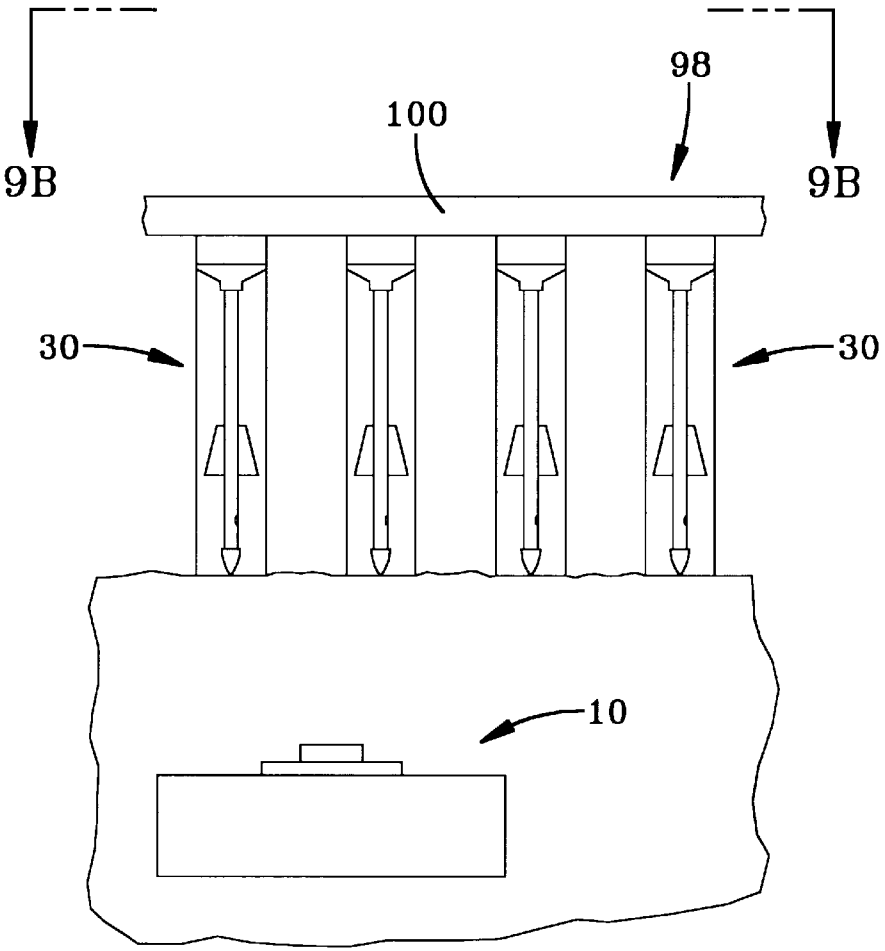
FIG. 9A is an elevation view of an explosive device neutralization system, according to still yet another embodiment of the present invention.

While the foregoing embodiments of the present invention have been described as an individual neutralization system, other embodiments include different configurations including more than one of the individual neutralization systems described above. For example, FIGS. 9A and 9B show an elevation and a plan view, respectively, of a neutralization system 98 according to still yet another embodiment of the present invention. The neutralization system 98 includes multiple individual neutralization systems 30 arranged relative to each other in an array device 100. The array device 100 operates to provide support to and relative spacing between the individual neutralization systems 30. This spacing can be further understood with reference to FIG. 9B, which shows the individual neutralization systems 30 arranged in an array. While the array device 100 is shown in FIG. 9B as supporting 26 individual neutralization systems 30, and having a circular shape, it can support other numbers of individual neutralization systems and/or have other alternative shapes. With such an array device, multiple individual neutralization systems 30 can be easily and quickly placed in a suspected vicinity of one or more explosive devices, such as land mines 10. The array device 100 can be formed of any suitable material and with any suitable configuration for supporting the relative spacings of the individual neutralization systems 30. For example, the array device 100 can be formed of metal or hard plastic. Also, depending upon the material used, the array device 100 may be reusable after deployment of attached individual neutralization systems, or can be damaged or consumed during such deployment and not reused. The array device 100 can also have one or more fixing points for attachment of each individual neutralization system 30. In addition, the array device 100 can be configured as a solid form or a grid of elements, among other variations. Further, the array device 100 can be collapsible into a smaller overall size to allow for easier storage before placement of the neutralization system 98 in the vicinity of the target explosive devices, or when the individual neutralization systems 30 are not attached.

Figure 10:
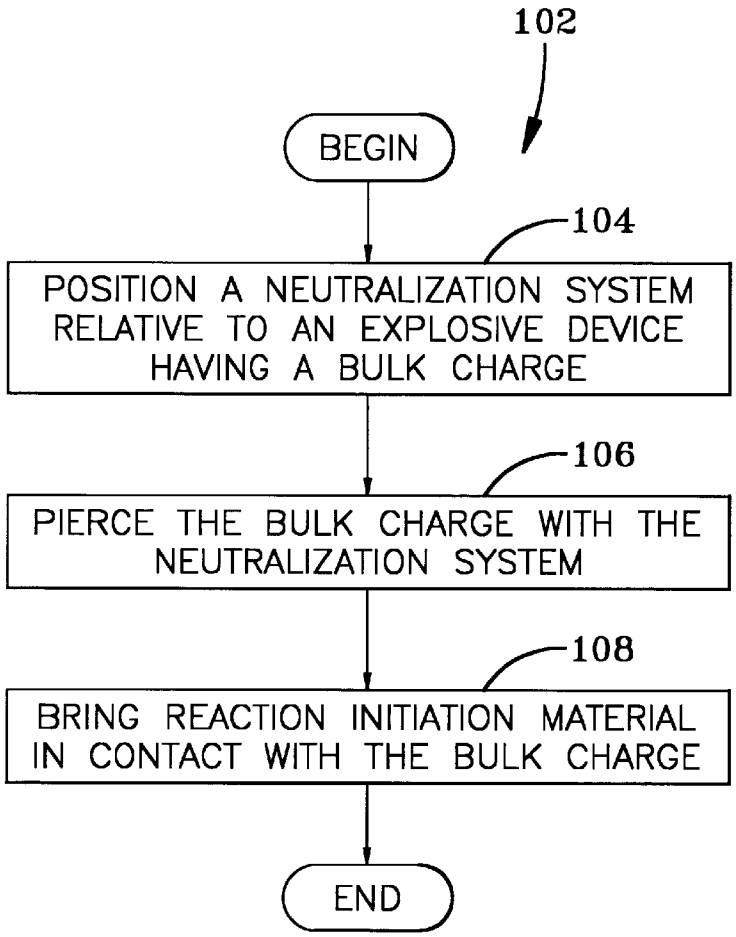
FIG. 10 is a process diagram of a method of neutralizing a bulk charge of an explosive device.

A method 102 for neutralizing a bulk charge of an explosive device is illustrated by the process diagram of FIG. 10. The method 102 includes positioning a neutralization system relative to an explosive device, having a bulk charge, in operation 104. For example, the neutralization system can be positioned on the ground surface above a buried mine (e.g., see FIG. 6), or can be positioned lying next to a bomb that is lying above the ground surface. In particular, the neutralization system is positioned so as to facilitate the other operations of the method 102 as described below. The neutralization system can be an individual neutralization system positioned alone or with one or more other individual neutralization systems which can be attached to each other through an array device.

In operation 106 the bulk charge is pierced with the neutralization system. Thus, in operation 104, the neutralization system is positioned to better facilitate such piercing. For example, when a particular end of the neutralization system includes a penetrating tip, that penetrating tip can be positioned closer to the explosive device than substantially all other portions of the neutralization system. In addition, the piercing of the bulk charge in operation 106 can include positioning at least a portion of a reaction initiation material within the bulk charge.

In some embodiments, a housing that surrounds the reaction initiation material can also be positioned within the bulk charge in operation 106. In such cases, operation 106 can also include creating an initial gap between the reaction initiation material and the bulk charge. This initial gap can be created with a penetrating tip that is wider than the remainder of the neutralization system that is within the bulk charge, and which passes into the bulk charge before the reaction initiation material. In some of the embodiments including a housing, the housing can include at least one egress hole, that is positioned within the bulk charge, exposing the reaction initiation material.

The reaction initiation material is brought into contact with the bulk charge in operation 108. In the case where no housing surrounds the reaction initiation material, the contact can be made when at least a portion thereof is positioned within the bulk material. Alternatively, in the case where a housing having an egress hole surrounds the reaction initiation material within the bulk charge, the reaction initiation material can pass through the egress hole to contact the bulk charge. This operation can also include burning the reaction initiation material. Such burning can facilitate the expansion of the reaction initiation material into contact with the bulk charge (e.g., through the egress hole), and, depending on the material forming the housing, can cause the formation of one or more egress holes or regions within a housing when included. As contact of operation 108 occurs, at least a portion of the bulk charge is transformed to become non-explosive. This, for example, can be through sufficient heating of that portion of the bulk charge for a sufficient period of time, or through a chemical reaction between the reaction initiation material and the bulk charge. While a portion of the bulk charge can be so disabled, preferably substantially all of the bulk charge is caused to become non-explosive.

Figure 11:
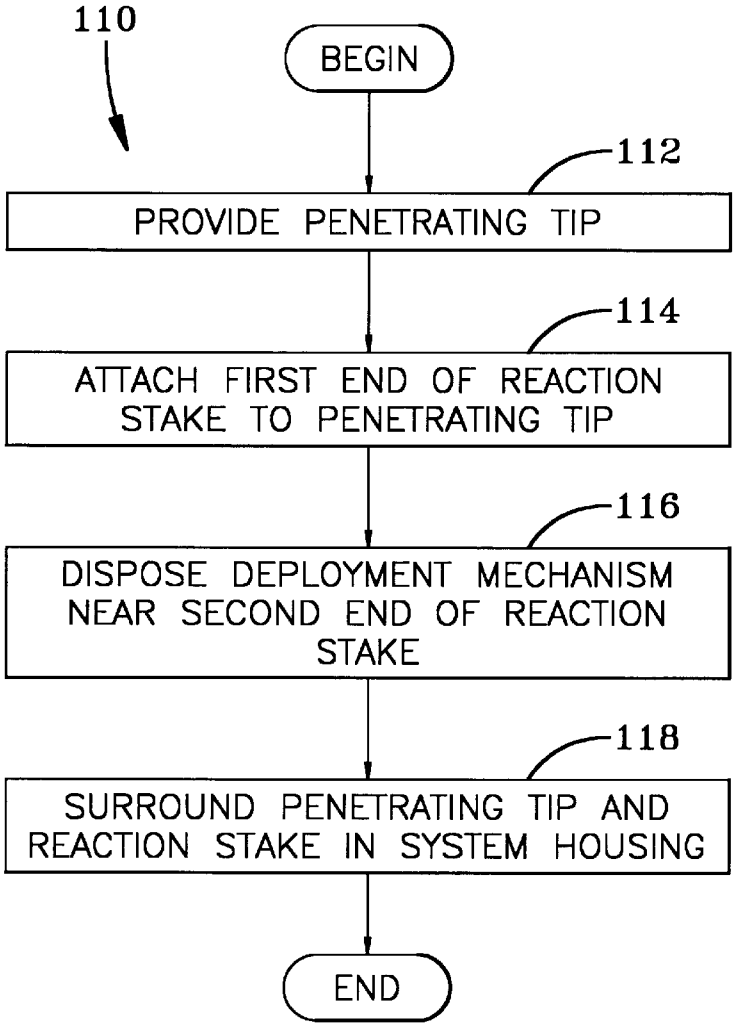
FIG. 11 is a process diagram of a method of forming an explosive device neutralization system, according to an embodiment of the present invention.

FIG. 11 is a process diagram of a method 110 for forming an explosive device neutralization system, according to an embodiment of the present invention. A penetrating tip is provided in operation 112. The material and shape of the penetrating tip is configured to facilitate passage of the penetrating tip into and through an explosive device. Therefore, the penetrating tip can be formed of any suitable durable material, such as steel or other hard metal. Also, the penetrating tip can have a conical, ogival, or other suitable shape.

In operation 114, a lower end of a reaction stake is attached to the penetrating tip provided in operation 112. Alternative versions of operation 114 are further described with reference to FIGS. 12 and 14. A deployment mechanism is disposed near an upper end of the reaction stake in operation 116. This deployment mechanism is configured to cause motion of the reaction stake and penetrating tip away from the deployment mechanism. In some embodiments, the deployment mechanism can be attached to the reaction stake such that during activation of the deployment mechanism, it becomes unattached from the reaction stake. Operation 116 is described in additional detail with reference to FIG. 15 below. Operation 118 includes surrounding the penetrating tip and the reaction stake in a system housing. This can be accomplished by affixing a casing to the deployment mechanism. This casing can be formed of an suitable durable material, such as metal or hard plastic, which can provide support and/or protection from the environment to the reaction stake and penetrating tip.

Figure 12:
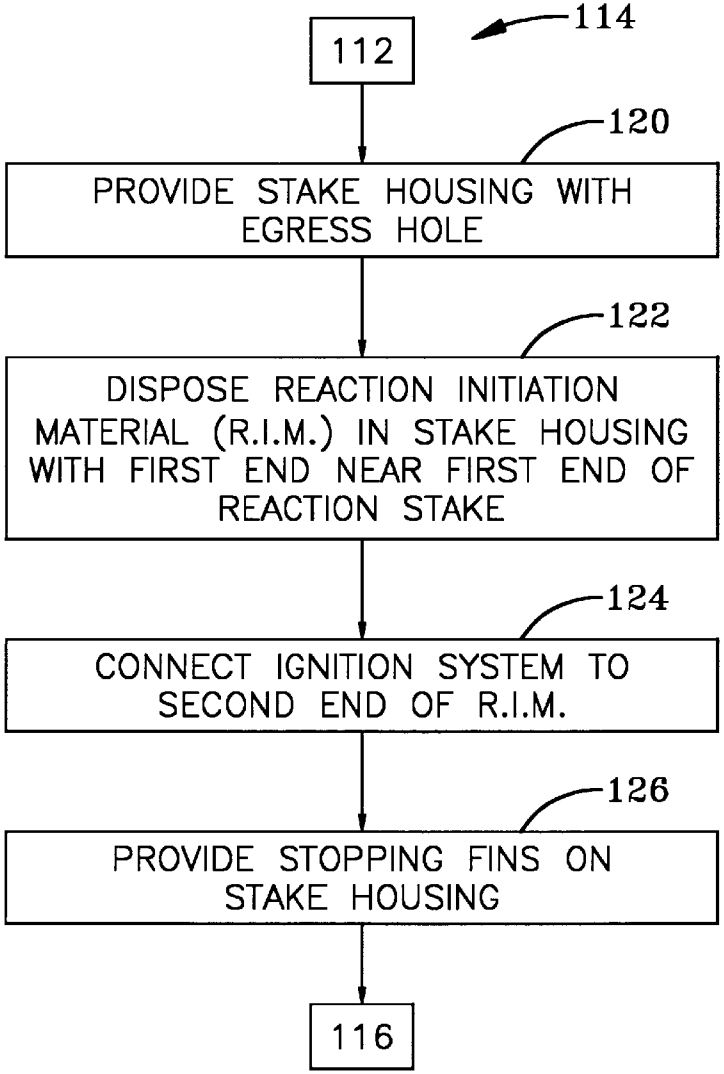
FIG. 12 is a process diagram of an operation in FIG. 11 of attaching a lower end of a reaction stake to the penetrating tip, according to an embodiment of the present invention.

FIG. 12 is a process diagram further detailing operation 114 of the method 110 in FIG. 11. In operation 120, a stake housing with an egress hole is provided. The stake housing can be formed of any suitable durable material, such as steel, another hard metal, or hard plastic, among others. An egress hole of suitable size for allowing the egress of burning R.I.M. from the stake housing, is included in the stake housing. For example, the egress hole can have a diameter of approximately 0.152 inches, with other sizes working well for particular R.I.M.'s and particular bulk charge materials.

In operation 122, reaction initiation material (R.I.M.) is disposed in the stake housing with a lower end near a lower end of the reaction stake. Also, the R.I.M. is disposed near the egress hole, such that burning R.I.M. can disperse through the egress hole. Operation 124 includes connecting an ignition system to an upper end of the R.I.M. Of course, the ignition system can be alternatively connected to or disposed near one or more other portions of the R.I.M. The ignition system is configured to initiate burning of the R.I.M. at a predetermined time after deployment of the reaction stake. Stopping fins are provided on the stake housing in operation 126. This can include affixing stopping fins on the stake housing provided in operation 120. Alternatively, the stopping fins can be integrally formed with the stake housing and provided at the same time as the stake housing is provided.

Figure 13:
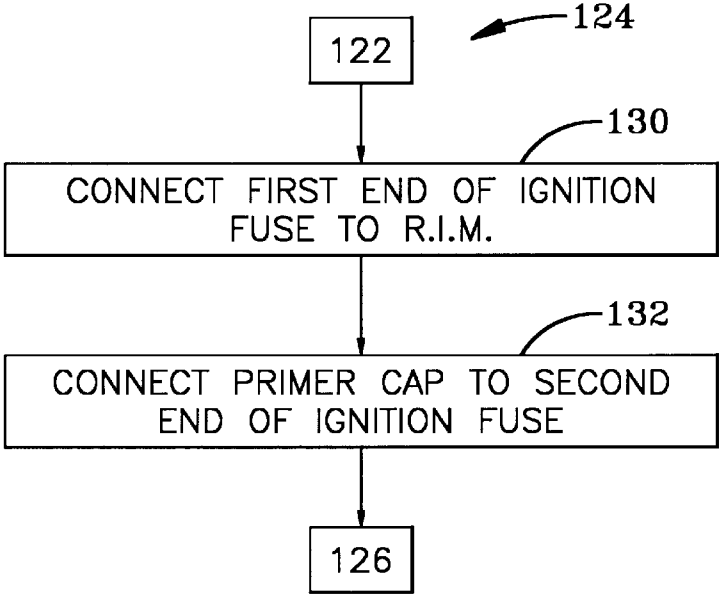
FIG. 13 is a process diagram of an operation in FIG. 12 of connecting an ignition system to an upper end of the reaction initiation material, according to an embodiment of the present invention.

FIG. 13 is a process diagram further detailing the operation 124 of FIG. 12. Operation 130 includes connecting a lower end of an ignition fuse to the R.I.M. disposed in operation 122 as shown in FIG. 12. In operation 132, a primer cap is connected to an upper end of the ignition fuse. These connections are made such that with burning of the primer cap, the ignition fuse can be burned, which in turn can initiate burning of the R.I.M. Of course, other alternative or additional operations can be performed to provide an ignition system and to connect it to or dispose it near the R.I.M.

Figure 14:
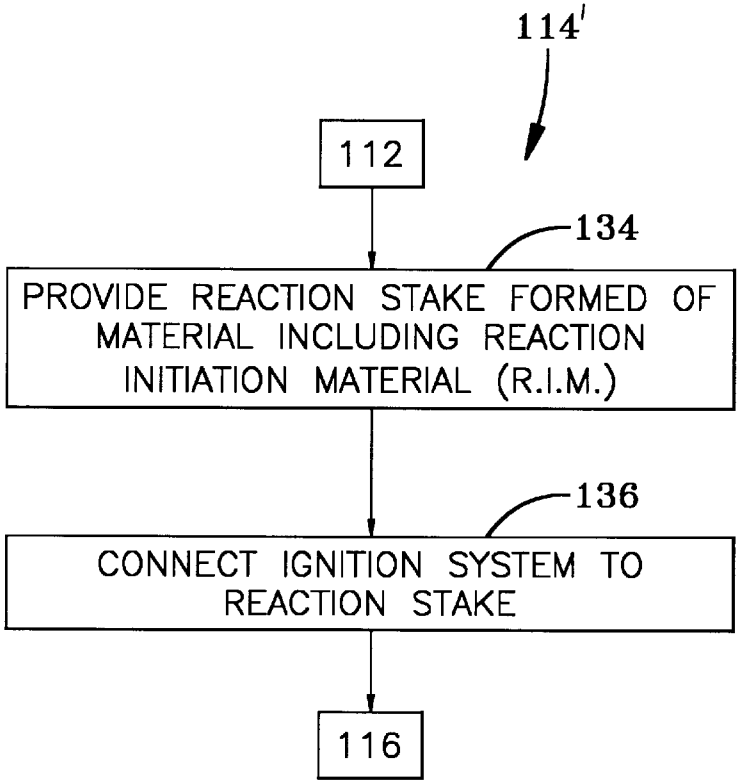
FIG. 14 is a process diagram of an operation in FIG. 11 of attaching a lower end of a reaction stake to the penetrating tip, according to another embodiment of the present invention.

FIG. 14 is a process diagram of an operation 114' that can be performed as an alternative to operation 114 of FIG. 12. A reaction stake formed of a material including a reaction initiation material (R.I.M.) can be provided in operation 134. Also, in operation 136 an ignition system can be connected to an end of the reaction stake such that burning of the ignition system can initiate burning of the R.I.M. Similar to the operations of FIG. 13, connecting the ignition system in operation 136 can include connecting a lower end of an ignition fuse to the reaction stake, and connecting a primer cap to an upper end of the ignition fuse.

Figure 15:
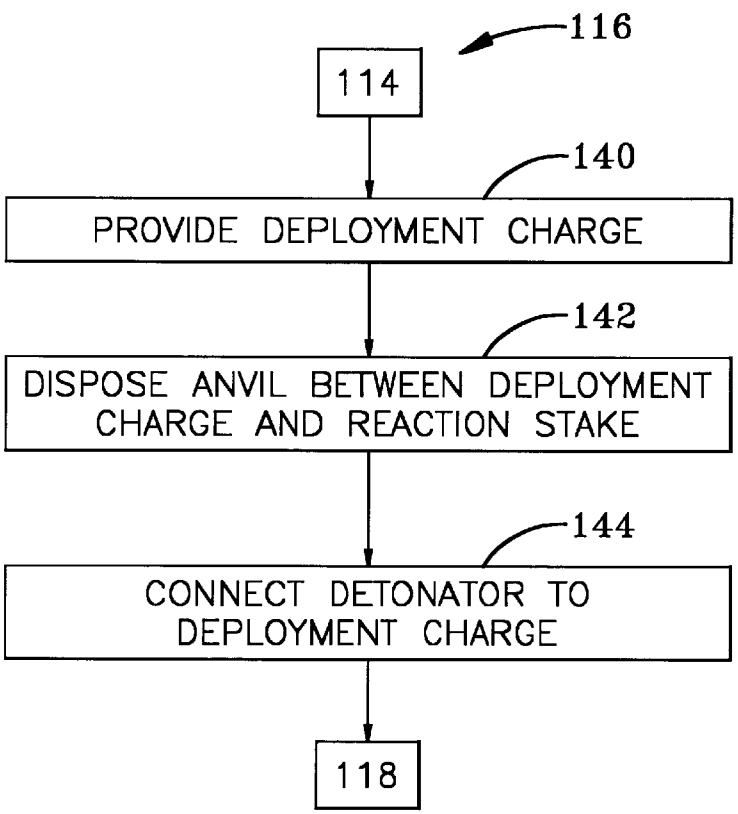
FIG. 15 is a process diagram of an operation in FIG. 11 of disposing a deployment mechanism near an upper end of the reaction stake, according to an embodiment of the present invention.

FIG. 15 is a process diagram of operation 116 of the method 110 in FIG. 11. A first side of an anvil is disposed adjacent the upper end of the reaction stake of operation 114, in operation 140. In operation 142, a deployment charge is disposed adjacent a second side of the anvil. The first and second sides of the anvil are substantially parallel to each other, such that when the deployment charge is burned (or exploded), the force imparted on the anvil is substantially translated to the reaction stake. The deployment charge can be formed of any suitable material, such as sheet explosive, DET, gunpowder, ANFO, and/or solid or liquid rocket propellant. Also, a detonator is connected to the deployment charge in operation 144. More specifically, the detonator is configured to cause the deployment charge to burn or explode under desired and controllable conditions. Of course, other techniques and operations can be used to dispose a deployment mechanism near an upper end of the reaction stake in operation 116 of method 110 in FIG. 11.

While the above embodiments of the present invention have been described with reference to neutralization of a buried mechanically activated land mine, it should be understood that the present invention is also configured for the neutralization of explosive systems of different types and/or under different conditions. For example, various embodiments of the present invention are configured and can be used to neutralize influence-type land mines, water mines, UXO, or terrorist-type bombs. Also for example, the present invention incorporates embodiments configured and usable for neutralization of explosive devices under natural or man-made camouflage, exposed, and/or with or without a casing or other components between the neutralization system and the bulk charge.

In addition to the advantage of substantially no collateral damage with the use of the present invention, this system is also effective in neutralizing explosive devices in a wider range of circumstances than are prior systems. For example, because the mechanism of neutralization is delivered directly to the bulk charge, the required system parameters are less sensitive to the type of bulk charge material. For example, a wide range of the temperatures attained by the R.I.M. are suitable for the deflagration or consumption of a variety of bulk charge materials. Also, the present invention is less affected by intervening objects in the medium (e.g., stones in the ground) between the neutralization system and explosive device, than are prior systems because the mass, strength, and shape of the reaction stake make it less subject to diversion. As another advantage, the effectiveness of the present invention is less sensitive to the type and amount of intervening medium. Therefore, for example, the present invention is more effective against explosive devices, such as influence-type land mines, that may be buried underground at a medium depth of greater than 10 centimeters, beyond which prior systems can have significantly reduced effectiveness.

In summary, the present invention provides structures and methods for disabling the bulk charge of an explosive device without exploding the bulk charge. In particular, the bulk charge is made non-explosive. The invention has been described herein in terms of several preferred embodiments. Other embodiments of the invention, including alternatives, modifications, permutations and equivalents of the embodiments described herein, will be apparent to those skilled in the art from consideration of the specification, study of the drawings, and practice of the invention. For example, a neutralization system can include a reaction stake formed entirely of R.I.M. which is caused to begin burning substantially directly by the burning or explosion of the deployment charge. The embodiments and preferred features described above should be considered exemplary, with the invention being defined by the appended claims, which therefore include all such alternatives, modifications, permutations and equivalents as fall within the true spirit and scope of the present invention.

What is claimed is:

1. A system for neutralizing a bulk charge of an explosive device, comprising:

a reaction stake having a first end and a second end, and including a reaction initiation material that can facilitate non-explosive neutralization of a bulk charge of an explosive device;

a deployment mechanism disposed near said first end of said reaction stake; and a penetrating tip disposed near said second end of said reaction stake.

2. The system for neutralizing a bulk charge of an explosive device as recited in claim 1, wherein said reaction initiation material can facilitate neutralization of said bulk charge when said reaction initiation material is burned.

3. The system for neutralizing a bulk charge of an explosive device as recited in claim 2, wherein said reaction initiation material includes one of the group consisting of magnesium-Teflon, thermites, solid rocket propellant, and liquid rocket propellant.

4. The system for neutralizing a bulk charge of an explosive device as recited in claim 1, wherein said reaction initiation material can facilitate neutralization of said bulk charge when said reaction initiation material is in contact with said bulk charge.

5. The system for neutralizing a bulk charge of an explosive device as recited in claim 1, wherein said reaction stake further includes a stake housing within which said reaction initiation material is disposed.

6. The system for neutralizing a bulk charge of an explosive device as recited in claim 5, wherein said reaction stake further includes at least one stopping fin formed of a hard material and radially extending from said stake housing.

7. The system for neutralizing a bulk charge of an explosive device as recited in claim 5, wherein said stake housing has at least one egress hole through which energy and material can pass when said reaction initiation material is burned.

8. The system for neutralizing a bulk charge of an explosive device as recited in claim 5, wherein said stake housing is formed of a material in which at least one egress hole, through which energy and material can pass, can form when said reaction initiation material is burned.

9. The system for neutralizing a bulk charge of an explosive device as recited in claim 5, wherein said reaction stake further includes an ignition system in proximity to said reaction initiation material.

10. The system for neutralizing a bulk charge of an explosive device as recited in claim 9, wherein said ignition system includes an ignition fuse having a first end and a second end and a primer cap, wherein said first end of said ignition fuse is proximate said reaction initiation material and said primer cap is proximate said second end of said ignition fuse.

11. The system for neutralizing a bulk charge of an explosive device as recited in claim 1, wherein said deployment mechanism includes a spring.

12. The system for neutralizing a bulk charge of an explosive device as recited in claim 1, wherein said deployment mechanism includes one of the group consisting of a compressed gas and a compressed liquid.

13. The system for neutralizing a bulk charge of an explosive device as recited in claim 1, wherein said deployment mechanism includes a deployment charge and a detonator near said deployment charge.

14. The system for neutralizing a bulk charge of an explosive device as recited in claim 13, wherein said detonator includes a booster cap proximate a detonating cord.

15. The system for neutralizing a bulk charge of an explosive device as recited in claim 14, wherein said deployment charge includes at least one of the group consisting of a sheet explosive, a tile explosive, gunpowder, solid rocket propellant, and liquid rocket propellant.

16. The system for neutralizing a bulk charge of an explosive device as recited in claim 13, wherein said deployment mechanism further includes an anvil between said deployment charge and said reaction stake, wherein said anvil is formed of a hard material.

17. The system for neutralizing a bulk charge of an explosive device as recited in claim 1, wherein said penetrating tip is wider than said stake housing, has a pointed shape, and is formed of a hard material.

18. The system for neutralizing a bulk charge of an explosive device as recited in claim 17, wherein said penetrating tip is about 0.032 inches wider than said stake housing, has an ogival shape, and is formed of metal.

19. A system for neutralizing a bulk charge of an explosive device, comprising:

an array device; and a plurality of individual neutralization systems supported by said array device, wherein each individual neutralization system includes:

a reaction stake having a first end and a second end, and including a reaction initiation material that can facilitate non-explosive neutralization of said bulk charge of said explosive device;

a deployment mechanism disposed near said first end of said reaction stake; and a penetrating tip disposed near said second end of said reaction stake.

20. The system for neutralizing a bulk charge of an explosive device as recited in claim 19, wherein said reaction initiation material is formed of one of the group consisting of magnesium-Teflon, thermites, solid rocket propellant, and liquid rocket propellant, and wherein when said reaction initiation material is burned, released energy and material facilitates neutralization of said bulk charge.

21. The system for neutralizing a bulk charge of an explosive device as recited in claim 19, wherein said reaction stake further includes:

a stake housing in which said reaction initiation material is disposed, said stake housing having an egress hole proximate said reaction initiation material; and an ignition system proximate said reaction initiation material, including an ignition fuse and a primer cap.

22. The system for neutralizing a bulk charge of an explosive device as recited in claim 19, further comprising:

means for containing said reaction initiation material, having an egress hole, wherein said path is wider than said means for containing; and means for igniting said reaction initiation material, wherein when said reaction initiation material is ignited, energy and material pass through said egress hole.

* * * * *